US006575810B1

(12) United States Patent
Sohn

(10) Patent No.: US 6,575,810 B1
(45) Date of Patent: Jun. 10, 2003

(54) ILLUMINATING TOY FIGURE

(75) Inventor: George Sohn, Sherman Oaks, CA (US)

(73) Assignee: Toynami, Inc., Sherman Oaks, CA (US)

( * ) Notice: Subject to any disclaimer, the term of this patent is extended or adjusted under 35 U.S.C. 154(b) by 0 days.

(21) Appl. No.: 10/176,509

(22) Filed: Jun. 21, 2002

(51) Int. Cl.[7] ..... A63H 33/26

(52) U.S. Cl. ..... 446/485; 446/484; 446/330; 446/129; 446/130; 273/288; 273/237

(58) Field of Search ..... 446/485, 484, 446/129, 130, 139, 137, 330; 273/236, 237, 238, 288, 455, 454

(56) References Cited

U.S. PATENT DOCUMENTS

| | | | | | |
|---|---|---|---|---|---|
| 844,577 | A | * | 2/1907 | Borchardt | 446/371 |
| 2,767,517 | A | * | 10/1956 | Hooper | 446/139 |
| 3,237,345 | A | * | 3/1966 | Feliziani | 446/130 |
| 4,300,770 | A | * | 11/1981 | Knetzger | 273/238 |
| 4,314,423 | A | * | 2/1982 | Lipsitz et al. | 446/303 |
| 4,411,099 | A | * | 10/1983 | Cancel | 446/298 |
| 4,623,318 | A | * | 11/1986 | Tsiknopoulos et al. | 446/330 |
| 4,723,932 | A | * | 2/1988 | Kelley et al. | 446/330 |
| 4,836,823 | A | * | 6/1989 | Laven | 446/485 |
| 4,878,869 | A | * | 11/1989 | Yamane et al. | 446/130 |
| 4,938,730 | A | * | 7/1990 | Yamane et al. | 446/130 |
| 5,024,611 | A | * | 6/1991 | Eckerle et al. | 446/268 |
| 5,197,741 | A | * | 3/1993 | Wu | 273/237 |
| 5,277,643 | A | * | 1/1994 | Ejima | 446/93 |
| 5,295,889 | A | * | 3/1994 | Ejima | 446/91 |
| 5,466,181 | A | * | 11/1995 | Bennett et al. | 446/297 |
| 6,224,456 | B1 | * | 5/2001 | Wittenberg | 446/330 |
| 6,273,781 | B1 | * | 8/2001 | Yamasaki | 446/330 |

FOREIGN PATENT DOCUMENTS

| | | | | |
|---|---|---|---|---|
| JP | 2002166062 | A | * 6/2002 | A63H/11/18 |

* cited by examiner

*Primary Examiner*—Derris H. Banks
*Assistant Examiner*—Urszula M Cegielnik
(74) *Attorney, Agent, or Firm*—Lee & Hong

(57) ABSTRACT

An illuminating toy figure for use with a conductive surface and an energy source is disclosed. The toy figure includes a structure having means for securing a battery and a first and second terminal, a light source having a third and fourth terminals, a first and second appendages, and a circuit. The circuit provides for an arrangement where the first, second, third and fourth terminals are connected to a first and second conductive plates located in the first and second appendages, respectively, such that when the first and second conductive plates are in electrical contact via the conductive surface, the light source is illuminated. The toy figure further includes magnetic properties in order to adhere to metal surfaces and a plastic structure embodying humanoid qualities.

35 Claims, 4 Drawing Sheets

FIGURE 1A
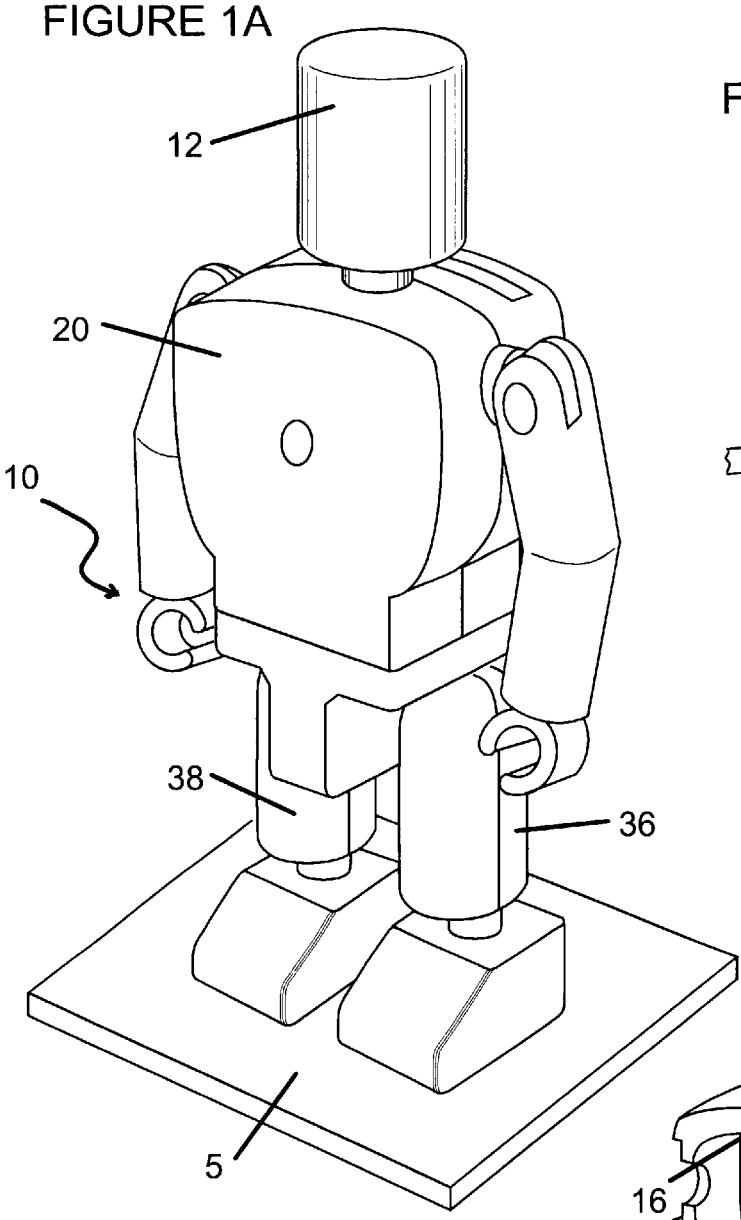
FIGURE 1B
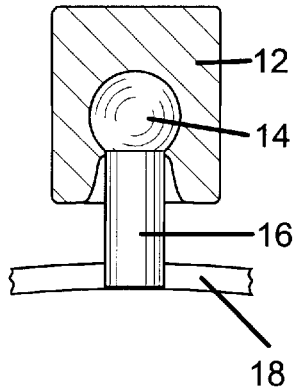
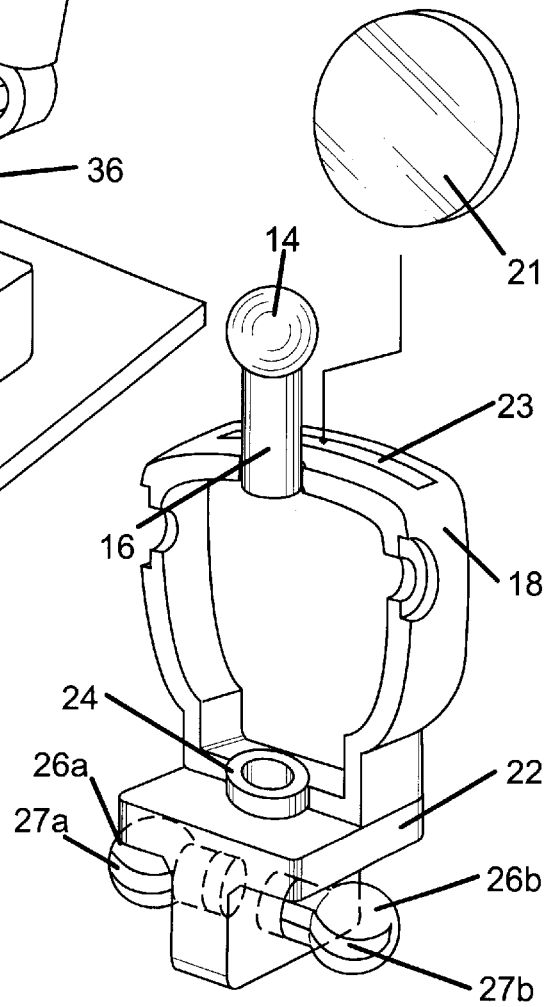
FIGURE 1C

ILLUMINATING TOY FIGURE

BACKGROUND OF THE INVENTION

1. Field of the Invention

The present invention relates to a toy figure, and more particularly, a toy figure with an automated internal lighting capability.

2. Description of the Related Art

Humanoid toy figures that employ lights or other illuminating devices are generally known. However, many of these toys require relatively larger cylindrical battery(ies) as a power source. Consequently, the toy figures are comparatively cumbersome and, since they are larger, tend to be more expensive in cost due to the additional material and labor required. Many times children become disappointed in being unable to transport the toy figures in question, such as on trips and in situations where the presence of larger toy figures is frowned upon. Additionally, such toys generally require a manual switch to be operated in order for the toy to be illuminated. Children, either through stubbornness or forgetfulness, often fail to turn off the illuminated toy figure, subsequently draining the power source. Parents must then spend additional amounts of money in order to purchase additional batteries to power to the toy figures. Although various attempts have been made to solve these and other problems associated with illuminating toy figures, as popularity of these figures become increases with respect to different types of cartoon and cinematic characters, an improved design is needed to provide a smaller, automated, and configurable illuminating toy figure.

SUMMARY OF THE INVENTION

Accordingly, the present invention is directed to a toy figure that substantially obviates one or more of the problems due to limitations and disadvantages of the related art.

An object of the present invention is to provide a toy figure that illuminates without requiring the operation of a manual switch and that does not remain illuminated unless so desired.

Another object of the present invention is to provide a toy figure that has magnetic properties so as to allow the figure to adhere to surfaces having magnetic properties.

Another object of the present invention is to provide an illuminated toy figure that is relatively smaller in size and less costly as well as configurable according to popular taste.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a toy figure for use with a conductive surface and an energy source, comprising a structure having means for securing a battery and a first and second terminal, a light source having a third and fourth terminal, a first and second appendages, and a circuit wherein the first, second, third and fourth terminals are connected to a first and second conductive plates located in the first and second appendages, respectively, such that when the first and second conductive plates are in electrical contact via the conductive surface, the light source is illuminated.

According to one aspect of the preferred embodiment, the light source of the toy figure is one or more light emitting diodes (LED's).

According to another aspect of the preferred embodiment, the conductive plates are magnetized.

According to another aspect of the preferred embodiment, the structure is of a plastic material.

In another embodiment of the present invention, the toy figure does not require use of a conductive surface.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

FIG. 1A illustrates a front perspective view of an assembled illuminating toy figure according to a preferred embodiment of the present invention;

FIG. 1B illustrates a cross-sectional view of the head and neck of the illuminating toy figure according to the preferred embodiment of the present invention;

FIG. 1C illustrates a front perspective view of the disassembled torso of the illuminating toy figure according to the preferred embodiment of the present invention;

DETAILED DESCRIPTION OF THE PREFERRED EMBODIMENTS

With reference to the drawings, the embodiments incorporating the principles, features and concepts of the present invention will be described.

Figure 2:
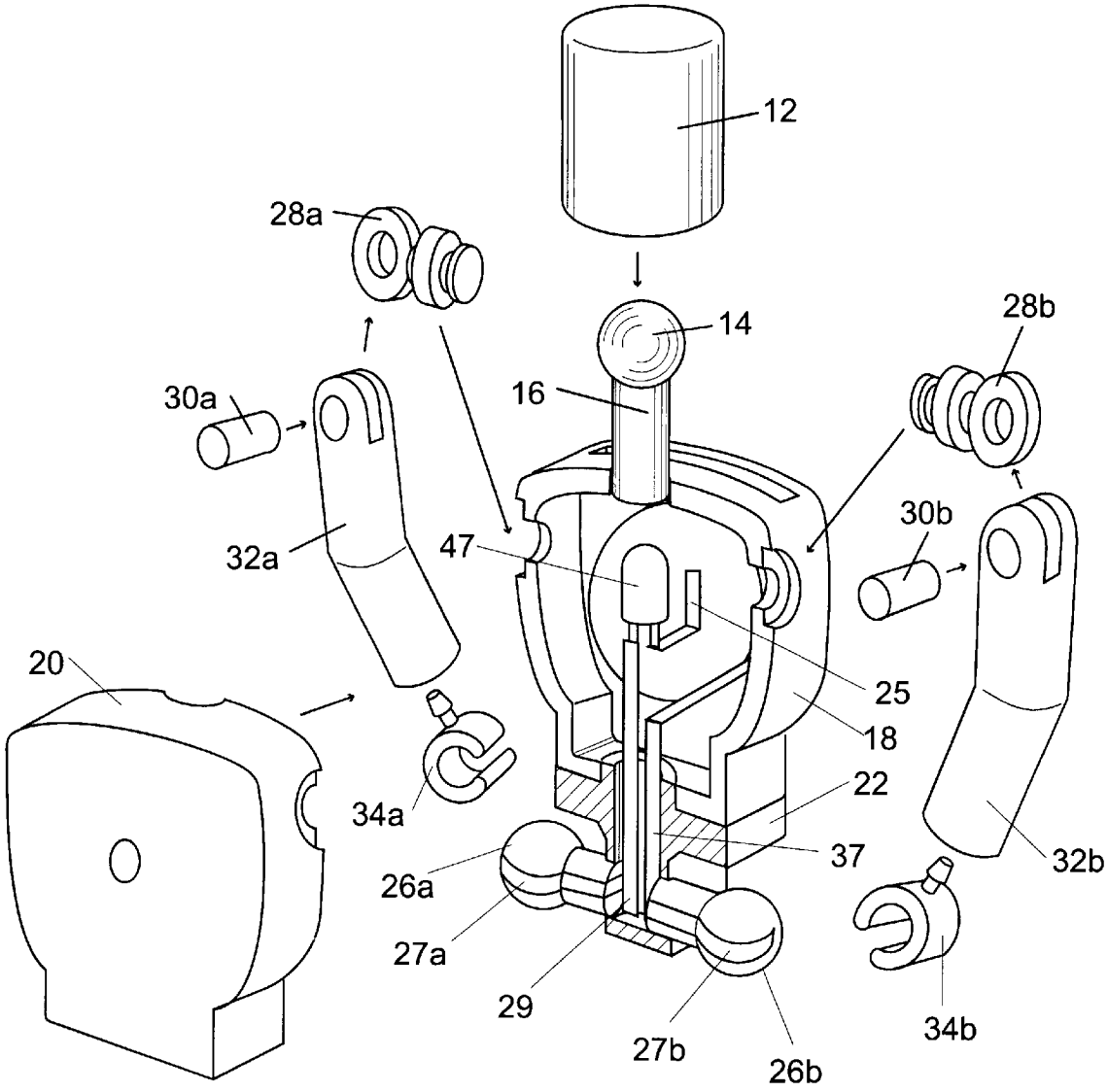
FIG. 2 illustrates a front perspective view of the disassembled upper body of the illuminating toy figure according to the preferred embodiment of the present invention.
Figure 3:
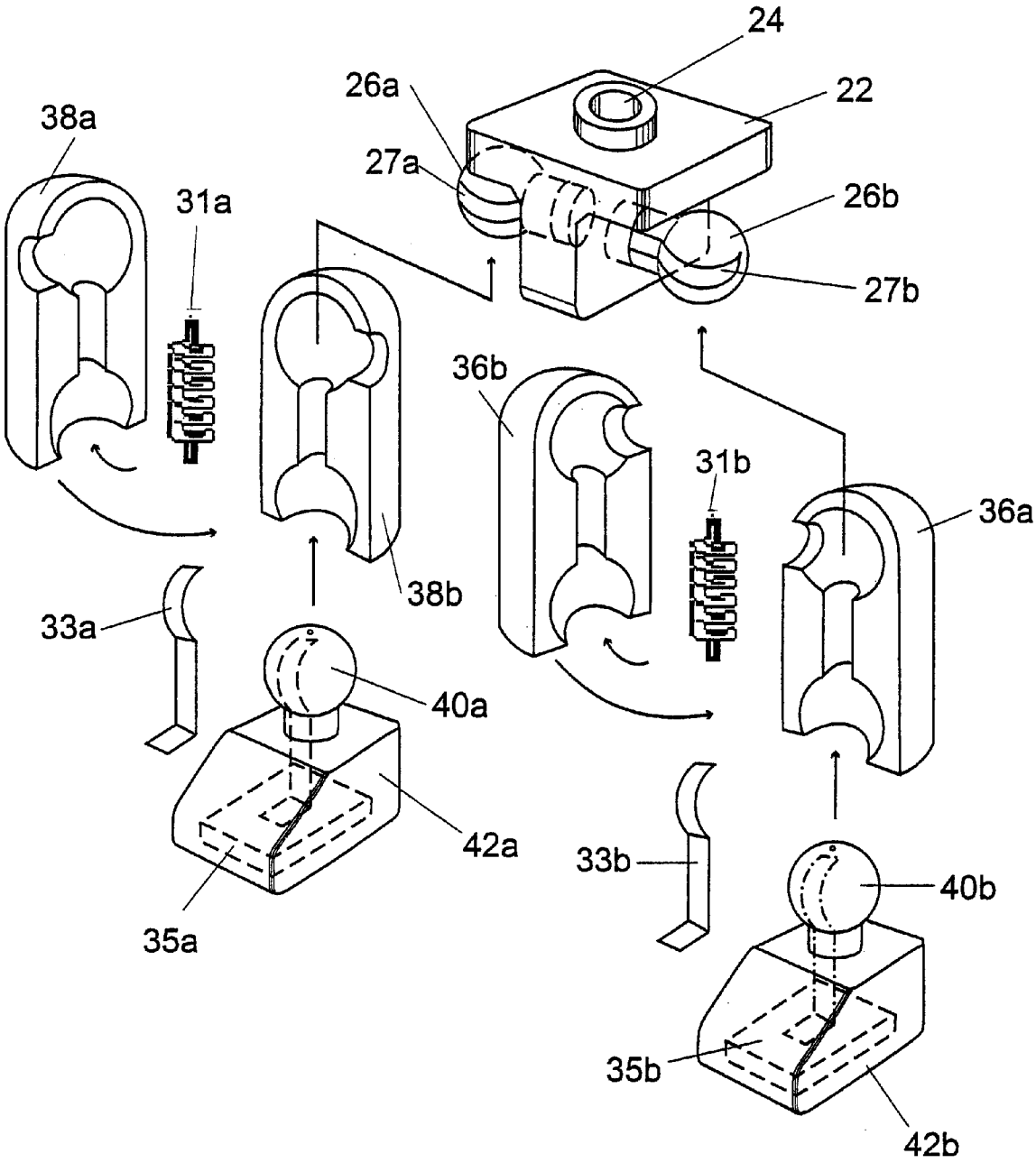
FIG. 3 illustrates a front perspective view of the disassembled lower body of the illuminating toy figure according to the preferred embodiment of the present invention.

FIG. 1A illustrates a front perspective view of the assembled illuminating toy FIG. 10 according to a preferred embodiment of the present invention. Preferably made of a plastic, the FIG. 10 with head 12 stands atop a metal or conductive surface 5 in order to complete a circuit, which causes a light-emitting diode (LED) to illuminate (not shown) within a casing formed by securing the rear torso 18 to the front torso 20. The circuit and LED are best seen in FIGS. 2 and 3 and further described below. The rear torso 18, which includes a slot 23 for inserting a battery, and front torso 20 are secured together by means known well to one skilled in the art, such as snap-fit or friction fit. These means of attachment hold true for the entire assembly of the toy FIG. 10.

In FIG. 1B, the head 12 contains a socket into which a ball 14 is inserted, thus creating a ball-and-socket joint that allows the head to rotate and swivel. The ball 14 is attached to a stem 16, which is further attached to the upper side of the rear torso 18. A semicircular cut-out, which is not shown, is located on the top edge of the front torso 20 to correspond to the front half of the neck stem 16 protruding from the top edge of the rear torso 18 (best seen in FIG. 3). Alternatively, the neck stem 16 can be removably secured to the torso by means of the rear torso 18 and front torso 20 portions clamping the neck stem 16.

FIG. 1C illustrates a perspective view of the rear torso 18 attached to the pelvis 22, which includes a horizontal plane that is centrally secured atop a vertical plane, forming an elongated T-structure. Both the rear torso 18 and front torso 20 (not shown) include semicircular cutouts at their respective bottom edges in order to clasp the circular T-joint structure 24, located atop the horizontal plane of the pelvis 22. When the rear and front torsos 18 and 20 are secured with the T-joint structure 24 in place, the pelvis 22 is attached to the torso. The circular T-joint structure 24 consists of an upper collar with inner and outer diameters secured to a lower collar with inner and outer diameters, thereby providing a hollow cylindrical opening into the pelvis 22. The upper and lower collars share the same inner diameter but the upper collar's outer diameter is greater than that of the lower collar, thereby forming a "T" when viewed cross-sectionally. The circular T-joint structure 24 not only serves as a means for attachment of the pelvis 22 to the torso, but also provides a conduit for terminals to pass through to the legs of the toy FIG. 10 (best seen in FIG. 2).

Also, in FIG. 1C, a battery 21, having positive and negative terminals, is shown being inserted into the slot 23 located on the rear part of the rear torso 18 in order to illuminate the LED (see FIG. 2). The battery 21 is preferably of the flat disc or coin type battery commonly found in wrist watches and small electronic items. Alternatively, the rear torso 18 can contain a compartment or cavity on the outer surface to house the battery 21. The rear torso 18, as well as the front torso 20 (shown in FIG. 3), includes graduated semicircular cutouts located on the upper sides to provide means for attaching the arms (best seen in FIG. 2). Finally, the pelvis 22 includes two ball members, 26*a* and 26*b*, located on either side of the vertical plane. On the surface of the two ball members 26*a* and 26*b* are electrical wire conduits 27*a* and 27*b* which consist part of the circuit and are in contact with the terminals that pass through the conduit provided by the circular T-joint structure 24. Alternatively, the two ball members 26*a* and 26*b* can be located underneath the horizontal plane of the pelvis and be situated adjacent and parallel to the vertical plane.

FIG. 2 illustrates an exploded view of the upper portions of the toy FIG. 10. Two shoulder joints, 28*a* and 28*b*, consist of circular collars attached to circular T-joints similar in description to the circular T-joint 24 of the pelvis 22 as described above, but without any cylindrical openings. These shoulder joints 28*a* and 28*b* are to be situated in the graduated semicircular cutouts located on upper sides of the front and rear torsos 20 and 18, respectively. When the front torso 20 and the rear torso 18 are secured together via snap-fit means or the like, the shoulder joints are also secured. The collars of the shoulder joints 28*a* and 28*b* are inserted into slots located in the upper area of the arms 32*a* and 32*b*, respectively. Once the collars of the shoulder joints 28*a* and 28*b* are placed inside the slots, shoulder pins 30*a* and 30*b* are inserted into holes, which are also located in the upper area of the arms 32*a* and 32*b* adjacent to the aforementioned slots, and through the collars of the shoulder joints 28*a* and 28*b*. As stated above, the pins are secured in place by means of friction fit, snap-fit, or other means well known by one of ordinary skill in the art. Finally, hands 34*a* and 34*b*, which include pegs, are inserted into holes and are maintained again by means of friction fit, snap-fit, and the like.

Also in FIG. 2, a cross-sectional view of the pelvis 22 is shown when attached to the rear torso 18. As described in FIG. 1C, the battery 21 is inserted into the slot 23 on the rear torso 18. In preferred embodiments, an electrical conduit or lead 25 is in contact with the negative terminal of the battery 21. The conduit 25 is connected to an LED 47. Another electrical conduit 29 extends from the LED through the circular T-joint structure 24 (located on the pelvis 22), and is in contact with the conduit 27*a*, which is located on the ball member 26*a*. Similarly, an electrical conduit or lead 37 is in contact with the positive terminal of the battery 21, extends through the circular T-joint structure 24 located on the pelvis 22, and is in contact with the conduit 27*b* located on the ball member 26*b*.

In preferred embodiments, assembly of the upper portions of the toy FIG. 10 is completed when the front torso 20 is fitted to the rear torso 18 after the shoulder joints 28*a* and 28*b* are situated in the graduated semi-circular cutouts located on either side of the rear torso and the circular T-joint structure 24 of the pelvis 22 is placed in the semicircular cutout located on the bottom of the rear torso. The shoulder joints 28*a* and 28*b* and the pelvis 22 are locked into place after attaching the front torso 20 to the rear torso 18.

FIG. 3 illustrates an exploded perspective view of the lower ions of the preferred embodiment of the present invention. As described above, the pelvis 24 contains ball members 26*a* and 26*b*, which contain electrical conduits 27*a* and 27*b*. These electrical conduits 27*a* and 27*b* are in contact with conduits 29 and 37 (shown in FIG. 2), which extend through the hollow cylinder of the circular T-joint 24. The legs of the toy FIG. 10 consist of two leg pieces for each of two legs, 36*a* and 36*b* and 38*a* and 38*b*. For example, the left leg is formed by attaching the leg piece 36*a* to its corresponding piece 36*b* by means of snap fit, friction fit or the like. The formation of the leg creates an upper and lower socket to receive ball members, such as 26*b* and 40*b*, and create ball-and-socket joints for the thigh and foot (described below). Also, a vertical shaft is created between the upper and lower sockets when the two leg pieces 36*a* and 36*b* are formed together in order to house an electrical conduit 31*b*, preferably in the shape of a spring. Consequently, when the leg pieces 36*a* and 36*b* are formed with the conduit 31*b* in between and around the ball members 26*b* and 40*b*, the circuit is extended because the electrical conduits 27*b* and 33*b* are in contact with the conduit 31*b*. The assembly is repeated for the right leg and foot, which involves leg pieces 38*a* and 38*b*, the electrical conduit 31 a, the ball members 26*a* and 40*a*, and the electrical conduits 27*a* and 33*a*. In preferred embodiments, the electrical conduits 31*a* and 31*b* are springs in order to facilitate fluid movement of the legs and feet while maintaining the circuit.

The feet 42*a* and 42*b* of the toy FIG. 10 shown in FIG. 3 have present ball members 40*a* and 40*b*, respectively, situated on their respective upper surfaces. This is in order to create ball-and-socket joints with the lower sockets of the legs as described above. Within the feet 42*a* and 42 and on the surface of the ball member 40*a* and 40*b* are electrical conduits 33*a* and 33*b*. The electrical conduits of the feet 33*a* and 33*b* maintain uniform contact with the conduits of the leg 31*a* and 31*b*, respectively. When the leg pieces, such as 36*a* and 36*b*, are secured together with the electrical conduits 27*b*, 31*b* and 33*b* and the ball members 26*b* and 40*b* situated between the leg pieces, the ball-and-socket joints for the foot 42*b* and leg 36 are formed. Subsequently, the leg 36 is secured to the pelvis 22 and foot 42*b*. The assembly described above hold true for the leg 38 and foot 42*a* as well.

Finally, in FIG. 3, the bottoms of the feet 42*a* and 42*b* are shown to have conductive plates 35*a* and 35*b*, respectively. These conductive plates 35*a* and 35*b* are in contact with the electrical conduits 33*a* and 33*b*, respectively. Consequently, when the assembled toy FIG. 10 is placed on a metal or conductive surface 5, as shown in FIG. 1A, the metal or conductive surface 5 completes the circuit within the toy FIG. 10. As a result, energy from the battery 21 illuminates the LED 47. In the preferred embodiment, the conductive plates 35*a* and 35*b* are magnetized and are disposed of on the bottom surface of the feet 42*a* and 42*b*. As a result, the figure can remain standing upright on a surface having magnetic properties, even if the surface is inclined or vertical. Alternatively, the feet 42*a* and 42*b* may be magnetized so as to provide the figure those same abilities.

Figure 4:
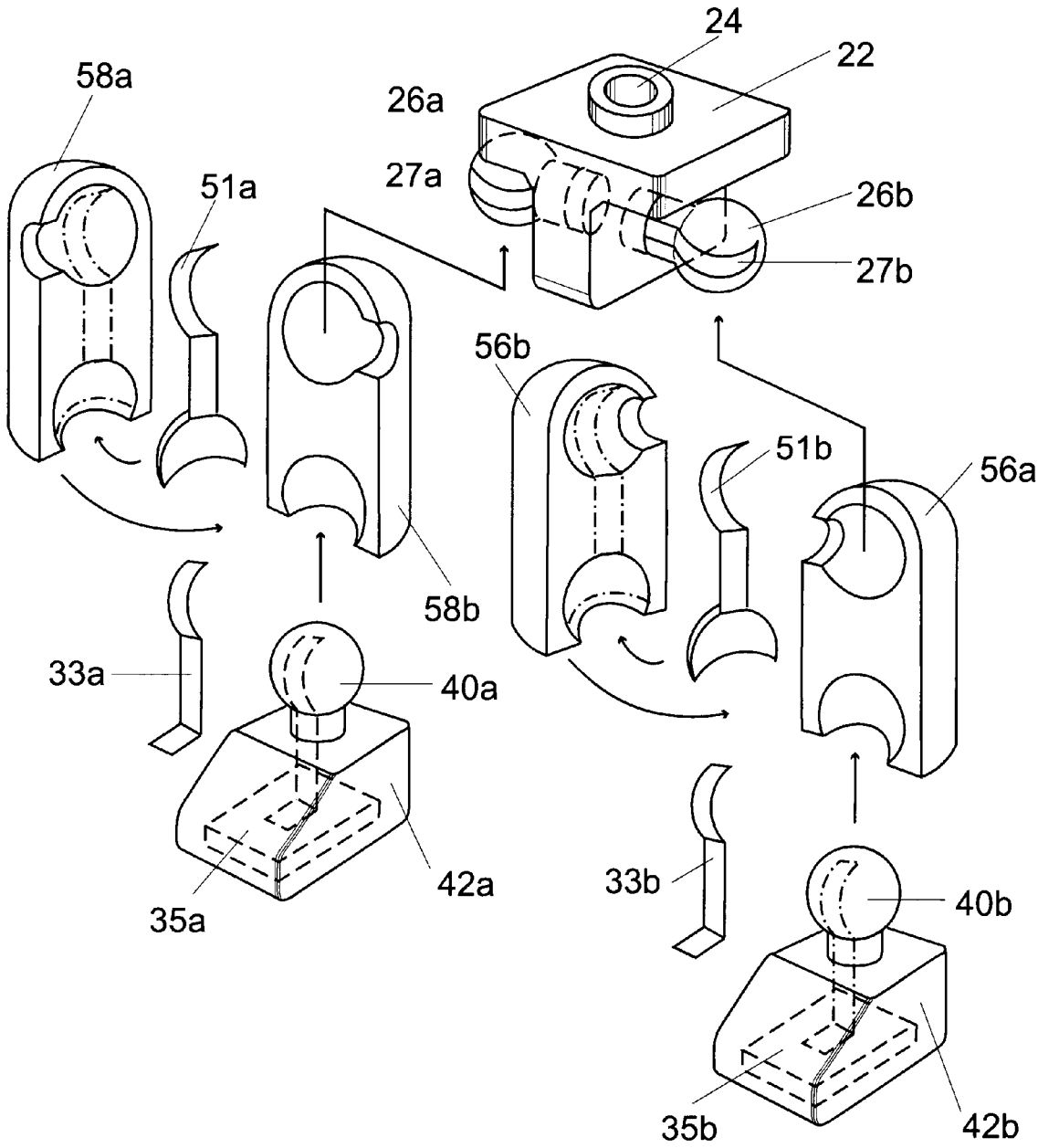
FIG. 4 illustrates a front perspective view of the disassembled lower body of the illuminating toy figure according to an alternative embodiment of the present invention.

FIG. 4 illustrates an exploded perspective view of the lower portions of an alternative embodiment of the present invention. As described previously, the pelvis 24 contains ball members 26*a* and 26*b*, which contain electrical conduits 27*a* and 27*b*. These electrical conduits 27*a* and 27*b* are in contact with conduits 29 and 37 (as shown in FIGS. 2 and 3), which extend through the hollow cylinder of the circular T-joint 24. In this alternative embodiment, the legs consist of two leg pieces for each of two legs, 56*a* and 56*b* and 58*a* and 58*b*. Similar to the preferred embodiment described in FIG. 3, the left leg is formed by attaching the leg piece 56*a* to its corresponding piece 56*b* by means of snap fit, friction fit or the like. The formation of the leg creates an upper and lower socket to receive ball members, such as 26*b* and 40*b*, and create ball-and-socket joints for the thigh and foot (described above). However, in order to continue the circuit mentioned previously, an electrical conduit 51*b* is inserted between the two leg pieces 56*b* and 56*b*. Consequently, when the leg pieces 36*a* and 36*b* are formed with the conduit 31*b* in between and around the ball members 26*b* and 40*b*, the circuit is extended because the electrical conduits 27*b* and 33*b* are in contact with the conduit 51*b*. The assembly is repeated for the right leg and foot, which involves leg pieces 58*a* and 58*b*, the electrical conduit 51*a*, the ball members 26*a* and 40*a*, and the electrical conduits 27*a* and 33*a*. In this alternative embodiment, the electrical conduits 51*a* and 51*b* have curved ends to form fit the sockets, which also facilitate fluid movement of the legs and feet while maintaining the circuit.

It will be apparent to those skilled in the art that various modifications and variations can be made in the present invention without departing from the spirit or scope of the invention. For example, the conductive plates 35*a* and 35*b* can alternatively be disposed within the hands 34*a* and 34*b* so that if the figure were to grip a conductive material, such as a metal rod, then the light source within the figure would be illuminated. Additionally, the structure of the present invention can be applied to figures other than humanoid, such as quadrupeds and vehicles, wherein the conductive plates would be disposed of in the tires for example. Thus, it is intended that the present invention cover the modifications and variations of this invention provided they come within the scope of the appended claims and their equivalents.

What is claimed is:

1. A toy figure for use with a conductive surface and an energy source, the toy figure comprises:

a structure with means for securing a battery and securing a first and second terminals opposite in polarity within the toy figure such that the battery is in contact with the first and second terminals;

a light source having a third and fourth terminals;

a first and second appendages; and a circuit wherein the first, second, third and fourth terminals are connected to a first and second conductive plates located in the first and second appendages, respectively, such that when the first and second conductive plates are in electrical contact via the conductive surface, the light source is illuminated.

2. The toy figure of claim 1, wherein the light source is one or more light emitting diodes.

3. The toy figure of claim 1, wherein the structure is made of a plastic material.

4. The toy figure of claim 1, wherein the first and second conductive plates are magnets.

5. The toy figure of claim 1, wherein the circuit comprises:

a first conduit extending from the first terminal and in electrical contact with a second conduit;

a third conduit in electrical contact with the second conduit and in electrical contact with a fourth conduit, which is in electrical contact with the first conductive plate;

a fifth conduit extending from the second terminal and in electrical contact with the fourth terminal;

a sixth conduit extending from the third terminal and in electrical contact with a seventh conduit; and an eighth conduit in electrical contact with the seventh conduit and in electrical contact with a ninth conduit, which is in electrical contact with the second conductive plate.

6. The toy figure of claim 5, wherein the structure comprises:

the first and second appendages are the first and second feet;

a head;

a neck with a first and second ends, wherein the first end is attached to the head;

a first and second shoulders;

a first and second arms;

a pelvis having a first and second ball members, wherein the second and seventh conduits are situated on the surface of the first and second ball members, respectively, and extend into the pelvis;

a rear torso piece, wherein the means for securing the battery, first through fourth terminals, the light source and the first, fifth and sixth conduits are disposed, having a means for receiving and housing the battery;

a front torso piece removably affixed to the rear torso piece;

a first and second ball members situated on top of the first and second feet, respectively, wherein the fourth and ninth conduits are situated on the surface of the first and second ball members, respectively; and a first and second legs, wherein the third and eighth conduits are disposed within the first and second legs, respectively.

7. The toy figure of claim 6, wherein the rear torso piece is removably affixed to the front torso piece via friction fit.

8. The toy figure of claim 6, wherein the rear torso piece is removably affixed to the front torso piece via snap-fit.

9. The toy figure of claim 6, wherein the front torso piece is translucent.

10. The toy figure of claim 6, wherein the second end of the neck is attached to the rear torso piece.

11. The toy figure of claim 6, wherein the pelvis comprises:

a horizontal plane with a top and bottom surface;

a vertical plane with a first and second sides, wherein the vertical plane is attached to the bottom of the horizontal plane so as to form a T-structure and the first and second ball members are attached to the first and second sides of the vertical plane, respectively;

a circular T-joint located on the top surface of the horizontal plane, which the front and rear torso pieces clasp so as to provide a means for securing the pelvis to the front and rear torso pieces, wherein the circular T-joint comprises:

a lower collar with an inner and an outer diameter and is located on the surface of the horizontal plane; and an upper collar situated on top of the and secured to lower collar, sharing the same inner diameter as the lower collar but with an outer diameter that is greater than the outer as diameter of the lower collar; and a hollow cylindrical opening into the circular T-joint and pelvis so as to allow the first and sixth conduits to extend from the torso and to be in electrical contact with the second and seventh conduits.

12. The toy figure of claim 6, wherein the pelvis comprises:

a horizontal plane with a top and bottom surface;

a vertical plane with a first and second sides, wherein the vertical plane is attached to the bottom of the horizontal plane so as to form a T-structure and the first and second ball members are attached to the bottom surface of the horizontal plane so that the vertical plane is situated between the first and second ball members;

a circular T-joint located on the top surface of the horizontal plane, which the front and rear torso pieces clasp so as to provide a means for securing the pelvis to the front and rear torso pieces, wherein the circular T-joint comprises:

a lower collar with an inner and an outer diameter and is located on the surface of the horizontal plane; and an upper collar situated on top of the and secured to lower collar, sharing the same inner diameter as the lower collar but with an outer diameter that is greater than the outer diameter of the lower collar; and a hollow cylindrical opening into the circular T-joint and pelvis so as to allow the first and sixth conduits to extend from the torso and to be in electrical contact with the second and seventh conduits.

13. The toy figure of claim 6, wherein the first leg comprises:

a first half removably affixed to a second half, wherein each half has an upper and lower cavity, so as to form a leg containing an upper and lower sockets, which encase the first ball member of the pelvis and the ball member of the first foot, respectively, thereby forming ball-and-socket joints; and the fourth conduit disposed in between the first and second halves so as to provide an electrical connection between the third and fifth conduits.

14. The toy figure of claim 6, wherein the second leg comprises:

a first half removably affixed to a second half, wherein each half has an upper and lower cavity, so as to form a leg containing an upper and lower sockets, which encase the second ball member of the pelvis and the ball member of the second foot, respectively, thereby forming ball-and-socket joints; and the eighth conduit disposed in between the first and second halves so as to provide an electrical connection between the seventh and ninth conduits.

15. The toy figure of claim 6, wherein the first and second shoulders each comprise:

a circular T-joint, which the front and rear torso pieces clasp so as to provide a means for securing the shoulder to the front and rear torso pieces, wherein the circular T-joint comprises:

an inner disc with a diameter secured to an outer disc with a diameter smaller than the diameter of the inner disc; and a base disc secured to the outer disc; and a collar secured perpendicularly to the base disc.

16. The toy figure of claim 15, wherein the first and second arms each comprise:

an arm with first and second ends, wherein a slot to receive the collar of the shoulder is disposed in the first end;

a first opening connected to the slot to receive a pin to secure the arm to the shoulder is disposed in the first end; and a second opening disposed in the second end; and a hand having a peg, which is inserted into the second opening of the are, thereby securing the hand to the arm.

17. The toy figure of claim 6, wherein the first and second feet are magnetized.

18. The toy figure of claim 5, wherein the third and eighth conduits are springs.

19. A toy figure for use with an energy source, the toy figure comprises:

means for securing a battery and securing a first and second terminals opposite in polarity within the toy figure such that the battery is in contact with the first and second terminals;

a light source having a third and fourth terminals;

a first and second appendages; and a circuit wherein the first, second, third and fourth terminals are connected to a first and second conductive plates located in the first and second appendages, respectively, such that when the first and second conductive plates are in electrical contact, the light source is illuminated.

20. The toy figure of claim 19, wherein the light source is one or more light emitting diodes.

21. The toy figure of claim 19, wherein the toy figure is made of a plastic material.

22. The toy figure of claim 19, wherein the circuit comprises:

a first conduit extending from the first terminal and in electrical contact with a second conduit;

a third conduit in electrical contact with the second conduit and in electrical contact with a fourth conduit, which is in electrical contact with the first conductive plate;

a fifth conduit extending from the second terminal and in electrical contact with the fourth terminal;

a sixth conduit extending from the third terminal and in electrical contact with a seventh conduit; and an eighth conduit in electrical contact with the seventh conduit and in electrical contact with a ninth conduit, which is in electrical contact with the second conductive plate.

23. The toy figure of claim 22, wherein the toy figure further comprises:

the first and second appendages are the first and second feet;

a head;

a neck with a first and second ends, wherein the first end is attached to the head;

a first and second shoulders;

a first and second arms;

a pelvis having a first and second ball members, wherein the second and seventh conduits are situated on the surface of the first and second ball members, respectively, and extend into the pelvis;

a rear torso piece, wherein the means for securing the battery, first through fourth terminals, the light source and the first, fifth and sixth conduits are disposed, having a means for receiving and housing the battery;

a front torso piece removably affixed to the rear torso piece;

a first and second ball members situated on top of the first and second feet, respectively, wherein the fourth and ninth conduits are situated on the surface of the first and second ball members, respectively; and a first and second legs, wherein the third and eighth conduits are disposed within the first and second legs, respectively.

24. The toy figure of claim 23, wherein the rear torso piece is removably affixed to the front torso piece via friction fit.

25. The toy figure of claim 23, wherein the rear torso piece is removably affixed to the front torso piece via snap-fit.

26. The toy figure of claim 23, wherein the front torso piece is translucent.

27. The toy figure of claim 23, wherein the second end of the neck is attached to the the rear torso piece.

28. The toy figure of claim 23, wherein the pelvis comprises:

a horizontal plane with a top and bottom surface;

a vertical plane with a first and second sides, wherein the vertical plane is attached to the bottom of the horizontal plane so as to form a T-structure and the first and second ball members are attached to the first and second sides of the vertical plane, respectively;

a circular T-joint located on the top surface of the horizontal plane, which the front and rear torso pieces clasp so as to provide a means for securing the pelvis to the front and rear torso pieces, wherein the circular T-joint comprises:

a lower collar with an inner and an outer diameter and is located on the surface of the horizontal plane; and an upper collar situated on top of the and secured to lower collar, sharing the same inner diameter as the lower collar but with an outer diameter that is greater than the outer diameter of the lower collar; and a hollow cylindrical opening into the circular T-joint and pelvis so as to allow the first and sixth conduits to extend from the torso and to be in electrical contact with the second and seventh conduits.

29. The toy figure of claim 23, wherein the pelvis comprises:

a horizontal plane with a top and bottom surface;

a vertical plane with a first and second sides, wherein the vertical plane is attached to the bottom of the horizontal plane so as to form a T-structure and the first and second ball members are attached to the bottom surface of the horizontal plane so that the vertical plane is situated between the first and second ball members;

a circular T-joint located on the top surface of the horizontal plane, which the front and rear torso pieces clasp so as to provide a means for securing the pelvis to the front and rear torso pieces, wherein the circular T-joint comprises:

a lower collar with an inner and an outer diameter and is located on the surface of the horizontal plane; and an upper collar situated on top of the and secured to lower collar, sharing the same inner diameter as the lower collar but with an outer diameter that is greater than the outer diameter of the lower collar; and a hollow cylindrical opening into the circular T-joint and pelvis so as to allow the first and sixth conduits to extend from the torso and to be in electrical contact with the second and seventh conduits.

30. The toy figure of claim 23, wherein the first leg comprises:

a first half removably affixed to a second half, wherein each half has an upper and lower cavity, so as to form a leg containing an upper and lower sockets, which encase the first ball member of the pelvis and the ball member of the first foot, respectively, thereby forming ball-and-socket joints; and the fourth conduit disposed in between the first and second halves so as to provide an electrical connection between the third and fifth conduits.

31. The toy figure of claim 23, wherein the second leg comprises:

a first half removably affixed to a second half, wherein each half has an upper and lower cavity, so as to form a leg containing an upper and lower sockets, which encase the second ball member of the pelvis and the ball member of the second foot, respectively, thereby forming ball-and-socket joints; and the eighth conduit disposed in between the first and second halves so as to provide an electrical connection between the seventh and ninth conduits.

32. The toy figure of claim 23, wherein the first and second shoulders each comprise:

a circular T-joint, which the front and rear torso pieces clasp so as to provide a means for securing the shoulder to the front and rear torso pieces, wherein the circular T-joint comprises:

an inner disc with a diameter secured to an outer disc with a diameter smaller than the diameter of the inner disc; and a base disc secured to the outer disc; and a collar secured perpendicularly to the base disc.

33. The toy figure of claim 32, wherein the first and second arms each comprise:

an arm with first and second ends, wherein a slot to receive the collar of the shoulder is disposed in the first end;

a first opening connected to the slot to receive a pin to secure the arm to the shoulder is disposed in the first end; and a second opening disposed in the second end;

a hand having a peg that is inserted into the second opening of the are, thereby securing the hand to the arm.

34. The toy figure of claim 23, wherein the first and second feet are magnetized.

35. The toy figure of claim 22, wherein the third and eighth conduits are springs.

* * * * *